US011220872B2

(12) United States Patent
Diekmann et al.

(10) Patent No.: US 11,220,872 B2
(45) Date of Patent: Jan. 11, 2022

(54) SYSTEM AND METHOD OF TRACKING FLAT SURFACES OF A COMPONENT OF A DRILLING MACHINE

(71) Applicants: Caterpillar Global Mining Equipment LLC, Denison, TX (US); Caterpillar Global Mining HMS GmbH, Dortmund (DE)

(72) Inventors: Timo Diekmann, Castrop-Rauxel (DE); Ross L. Hoult, Queensland (AU); Carl J. Moberg, Dunlap, IL (US); Rex Glover, Deer Creek, IL (US); Hyppolite Kuissi, Peoria, IL (US); Samuel C. Taylor, Bungendore (AU); Ahsan Shahid, Peoria, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 230 days.

(21) Appl. No.: 16/549,807

(22) Filed: Aug. 23, 2019

(65) Prior Publication Data

US 2020/0308917 A1 Oct. 1, 2020

Related U.S. Application Data

(60) Provisional application No. 62/824,939, filed on Mar. 27, 2019.

(51) Int. Cl.

| | |
|---|---|
| ***E21B 19/16*** | (2006.01) |
| ***E21B 3/02*** | (2006.01) |
| ***E21B 19/14*** | (2006.01) |
| ***E21B 7/02*** | (2006.01) |

(52) U.S. Cl.
CPC ..... *E21B 19/165* (2013.01); *E21B 3/02* (2013.01); *E21B 7/025* (2013.01); *E21B 19/146* (2013.01)

(58) Field of Classification Search
CPC ..... E21B 19/146; E21B 19/16; E21B 19/161; E21B 19/165
See application file for complete search history.

(56) References Cited

U.S. PATENT DOCUMENTS

| | | | | |
|---|---|---|---|---|
| 4,449,592 | A | 5/1984 | Mayer | |
| 7,886,846 | B2 | 2/2011 | Pires | |
| 9,523,269 | B2 | 12/2016 | Hoult et al. | |
| 2003/0056988 | A1* | 3/2003 | Smith | E21B 3/06 175/57 |
| 2014/0338973 | A1 | 11/2014 | Taylor et al. | |

* cited by examiner

*Primary Examiner* — Kristyn A Hall
(74) *Attorney, Agent, or Firm* — Bookoff McAndrews PLLC

(57) ABSTRACT

A drilling machine includes a mast, a rotary head movably coupled to the mast, a drill string component having a pair of opposed flat surfaces, and a securing structure including engagement surfaces shaped to engage the opposed flat surfaces and secure the drill string component from rotating. The drilling machine also includes a controller configured to track a rotational location of the flat surfaces of the drill string component during rotation of the drill string component. The controller is further configured to receive tracking information from a sensor associated with the rotary head and control the rotary head to align the opposed flat surfaces for engagement by the securing structure.

20 Claims, 5 Drawing Sheets

SYSTEM AND METHOD OF TRACKING FLAT SURFACES OF A COMPONENT OF A DRILLING MACHINE

CROSS-REFERENCE TO RELATED APPLICATIONS

This application claims the benefit of priority under 35 U.S.C. § 119 to U.S. Provisional Patent Application No. 62/824,939, filed on Mar. 27, 2019, the entirety of which is incorporated herein by reference.

TECHNICAL FIELD

The present disclosure relates generally to drilling, and more particularly, to a system and method of coupling and decoupling components of a drilling machine.

BACKGROUND

Blasthole drilling machines may be used to form a series of blastholes in an excavating process. Such blasthole drilling machines may be mobile machines that drill a series of holes into rock or other material. Explosives may be placed in each of these holes, the detonation of which causes the rock and surrounding material to collapse, facilitating excavation and the formation of a new surface. In order to drill holes to a sufficient depth, blasthole drilling machines can include one or more drill pipes or other drill components that are removably attached to a drill string that presses a distally-located drill bit into rock. The pipes and drill bit of the drill string are rotated as a unit during drilling while the drill string advances downward.

The drilling process includes changes in a length of the drill string. For example, it may be necessary to add or remove one or more pipes to or from the drill string during the drilling process. This adding or removing of pipes requires fixing a portion of the drill string from rotation, for example by a bringing a wrench-type tool having opposing planar portions into contact with corresponding opposing flats located on the pipe. Aligning the planar portions of the wrench-type tool with the pipe flats may require operator intervention, such as multiple incremental rotations of the drill string, manual adjustment of the drill string, and/or visual confirmation of proper alignment. Such a process can reduce the efficiency of the drilling process, and in particular the pipe addition and removal process.

Similarly, when storing pipes of the drill string, it may be necessary to align the pipe flats with corresponding planar engagement surfaces of a pipe holder of the drilling machine. Accordingly, the process of placing the drill pipe in the pipe holder may also require multiple attempts each time a drill pipe is placed in the holder.

An exemplary automatic drill string section changer is disclosed in U.S. Pat. No. 4,449,592 ("the '592 patent") to Mayer. The drill string section changer described in the '592 patent is used to manipulate drill string sections and couplings. These drill string sections and couplings are stored in a storage rack that includes arms having spring-loaded clamping fingers. A roller clamp assembly having two semicircular surfaces to clamp a drill string coupling. The drill string section changer described in the '592 patent may require frequent maintenance to ensure operation of the spring-loaded clamping fingers. Additionally, the use of circular surfaces on a roller clamp assembly to rotationally fix a drill string coupling may require the application of large clamping forces, potentially increasing the rate of wear on the drill string coupling and on the roller clamp.

The disclosed machine and method may solve one or more of the problems set forth above and/or other problems in the art. The scope of the current disclosure, however, is defined by the attached claims, and not by the ability to solve any specific problem.

SUMMARY

In one aspect, a drilling machine may include a mast, a rotary head movably coupled to the mast, a drill string component having a pair of opposed flat surfaces, and a securing structure including engagement surfaces shaped to engage the opposed flat surfaces and secure the drill string component from rotating. The drilling machine may also include a controller configured to track a rotational location of the flat surfaces of the drill string component during rotation of the drill string component. The controller may be further configured to receive tracking information from a sensor associated with the rotary head and control the rotary head to align the opposed flat surfaces for engagement by the securing structure.

In another aspect, a mobile drilling machine system may include a mast, a rotary head movably coupled to the mast, a drill string component having a pair of opposed flat surfaces, a pipe storing carousel supporting the drill string component, and a pair of opposed engagement surfaces in the pipe storing carousel that engage the flat surfaces of the drill string component. The mobile drilling machine system may also include a sensor configured to detect a rotation of the rotary head and a controller configured to control the rotary head to rotate the drill string component into alignment with the pair of engagement surfaces in the carousel based on a change in a rotational location of the drill string component determined at least in part by the detected rotation.

In yet another aspect, a method for tracking a pair of flat surfaces of a drill string component may include determining a rotational location of the pair of flat surfaces, performing a drilling operation that includes rotating the drill string component, and tracking a change in the rotational location of the pair of flat surfaces during the drilling operation. The method may also include automatically rotating the drill component by an amount determined to place the drill string component in alignment with a deck wrench based on the tracked change in the rotational location.

BRIEF DESCRIPTION OF THE DRAWINGS

The accompanying drawings, which are incorporated in and constitute part of this specification, illustrate various exemplary embodiments and together with the description, serve to explain the principles of the disclosure.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
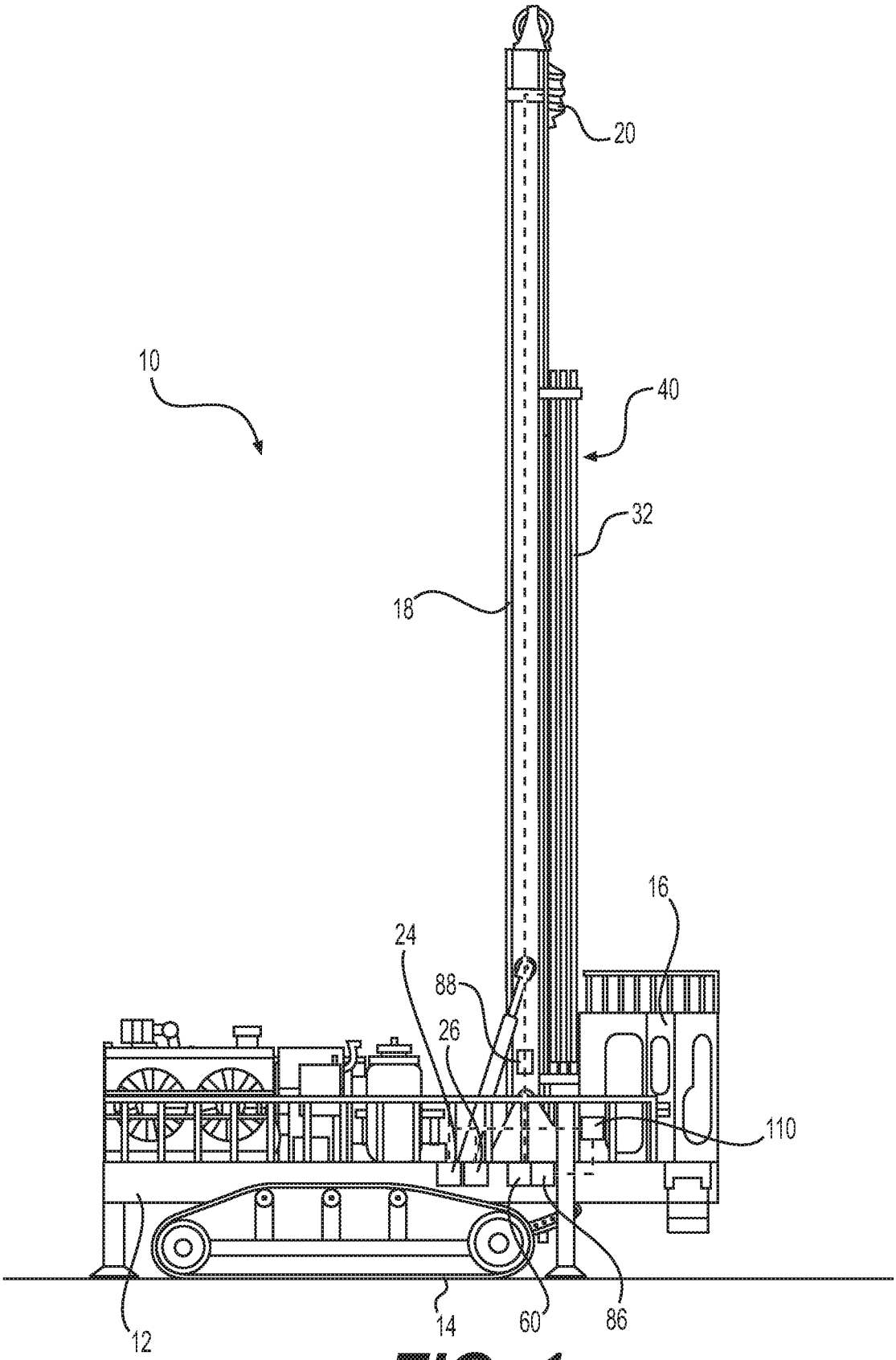
FIG. 1 is a schematic side view of an exemplary mobile drilling machine, according to aspects of the disclosure.

FIG. 1 is a schematic view illustrating components of a mobile drilling machine 10 that may be used to drill a series of blastholes. Mobile drilling machine 10 may include a frame 12, crawler tracks 14, an operator cab 16, and a drilling mast 18. Frame 12 may provide a support structure for operator cab 16 and drilling mast 18 while crawler tracks 14 form a mechanism for transporting mobile drilling machine 10 to multiple drilling locations. Drilling mast 18 may support a rotary head 20 and a pipe storing carousel 40. A deck wrench 60 may be connected to a deck wrench positioning valve 86 (shown adjacent to a lower portion of mast 18). One or more rotary head rotation-controlling valves 24 and one or more rotary head lift-controlling valves 26 may be provided on frame 12. A carousel positioning valve 88 may be provided adjacent to a lower portion of carousel 40.

Rotary head 20 may be hydraulically operated and configured to rotate one or more drill string components coupled to a distal end of rotary head 20. As used herein, drill string components may include individual drill pipes of a drill string, a drill bit of the drill string, or other components connected as part of the drill string. Hydraulic fluid lines (not shown) may connect respective hydraulic pumps to rotary head rotation-controlling valves 24 and rotary head lift-controlling valves 26. Valves 24 may allow control of rotation (speed and direction) of one or more components of rotary head 20. Rotary head 20 may be vertically movably coupled to drilling mast 18 such that rotary head 20 translates along a longitudinal axis of mast 18. In an exemplary configuration, rotary head 20 may be movable via a cable and pulley system that is controlled with a hydraulic cylinder (not shown) connected to rotary head lifting valves 26. Each of valves 24 and 26 may control the supply or draining of hydraulic fluid based on instructions from a controller 110. Deck wrench 60 may be movably positioned to engage a drill string component connected to rotary head 20, and controller 110 may provide instructions to positioning valve 86 to move the deck wrench 60 into and out of engagement with a drill string component via a hydraulic cylinder connected to deck wrench 60.

Carousel 40 may support and store a plurality of drill string components, such as drill pipes 32, that are coupled and de-coupled to rotary head 20 to produce a drill string of a desired length, to produce a hole with a desired depth. Carousel 40 may form a storage device to support and secure a plurality (e.g., four, five, six or more) drill string components. Controller 110 may provide instructions to carousel positioning valve 88 to swing carousel 40 between an aligned and withdrawn position. One or more carousel rotating valves may be provided to rotate carousel 40 any drill pipes 32 stored within carousel 40.

Operator cab 16 may include operator controls that allow one or more operators to monitor and control the operation of the various components of mobile drilling machine 10. For example, an operator interface provided within operator cab 16, or in another location, may issue control signals to controller 110 to control the operation of rotary head 20, carousel 40, and deck wrench 60 via rotary head rotating valves 24, rotary head lifting valves 26, deck wrench positioning valve 86, and carousel positioning valve 88. Controller 110 may control other components of mobile drilling machine 10, and may control other operations of rotary head 20, carousel 40, and deck wrench 60.

Figure 2:
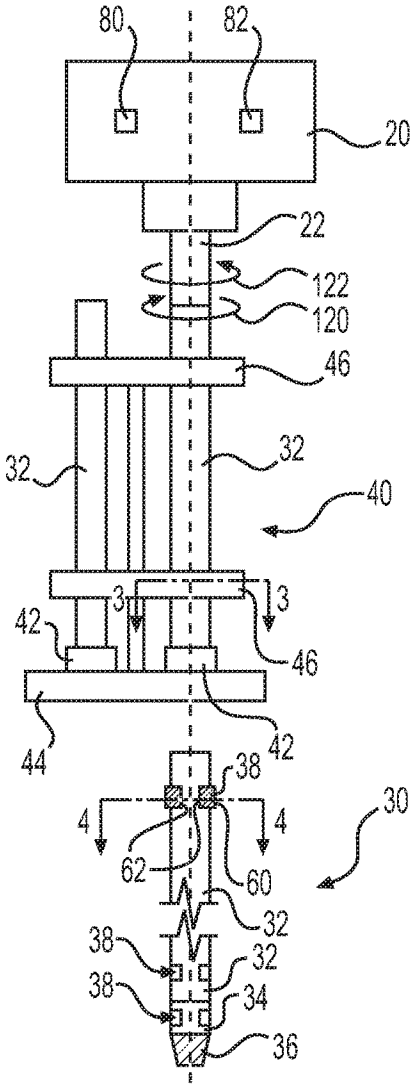
FIG. 2 is a schematic side view of a rotary head, drill string, carousel, and deck wrench of the mobile drilling machine of FIG. 1, with the carousel in an aligned position.

With reference to FIG. 2, rotary head 20 and carousel 40 may couple and decouple drill string components to form a drill string 30. A distal end of drill string 30 may include a drill bit 36, such as a hammer-type drill bit that is configured to bore into earth and rock. An adapter 34 may be connected to drill bit 36, for example by a threaded connection. Adapter 34 may be integrated with, or provided separably from, drill bit 36. A plurality of drill string extenders or drill pipes 32 stored in carousel 40 may be couplable to rotary head 20 by a threaded connection at a proximal end of each drill pipe 32. A distal end of each drill pipe 32 may be coupled, also by a threaded connection, to drill adapter 34, to another drill pipe 32, or to drill bit 36.

Each of the components of drill string 30 may be removably coupled to a distal end of a shaft 22 of rotary head 20. Rotary head 20 may include a hydraulic motor that rotates shaft 22 in either a coupling direction 120 (e.g., clockwise) or a decoupling direction 122 (e.g., counter-clockwise). This hydraulic motor may include a final-drive type gearbox in which the rotating components of the motor may rotate at different speeds as compared to drill string 30. Alternatively, the hydraulic motor may directly drive the drill string 30 (e.g., via shaft 22). While shaft 22 may be formed integrally with rotary head 20, shaft 22 may be removably coupled to rotary head 20 (e.g., by forming shaft 22 as an adapter). One or more rotary head position sensors 80 may detect a rotational speed, rotational location (position), and/or direction of rotation of the shaft of rotary head 20, as described below.

Carousel 40 may include features sized and shaped to retain a plurality of drill pipes 32. For example, the distal portion of carousel 40 may include a plurality of buckets 42 fixedly secured to a bottom plate 44. Each bucket 42 may be shaped to receive a distal end of a drill pipe component such as drill pipe 32. Buckets 42 may also be shaped to receive adapter 34 and/or drill bit 36. A pair of retainer members 46 may be included with carousel 40. Bottom plate 44 may be connected to a support structure (not shown) that is configured to swing carousel 40 between an aligned position (FIG. 2) and a withdrawn position (FIG. 5) by moving carousel 40 along an extension direction 90 and a withdrawal direction 92 in accordance with the operation of carousel positioning valve 88. A sensor such as a proximity sensor may be provided to detect a position of carousel 40, and may detect when carousel 40 is fully extended along direction 90 and output this information to controller 110. This signal may allow controller 110 to determine when carousel 40 is fully extended. The support structure may also be configured to controllably rotate bottom plate 44 so as to permit rotation of buckets 42 and retainer members 46 as a unit together with any drill pipes 32 supported by carousel 40.

Deck wrench 60 may be provided at a position that, when extended, may be generally axially aligned with drill head 20 and each component of drill string 30 along a vertical direction. As will be explained in more detail in connection with FIG. 4, deck wrench 60 may include a pair of flat engagement surfaces 62 that generally correspond to the shape of one or more pairs of flat surfaces or flats 38 on a drill string component. In one aspect, deck wrench 60 may form an exemplary securing structure, while engagement surfaces 62 may be shaped to engage flats 38 to secure a drill string component from rotating. Flats 38 may be, for example, two parallel and planar recesses formed about the circumferential surface of the drill string component and separated by 180 degrees. One, two, or more flats 38 may be provided along the longitudinal length of the drill string component.

Figure 3:
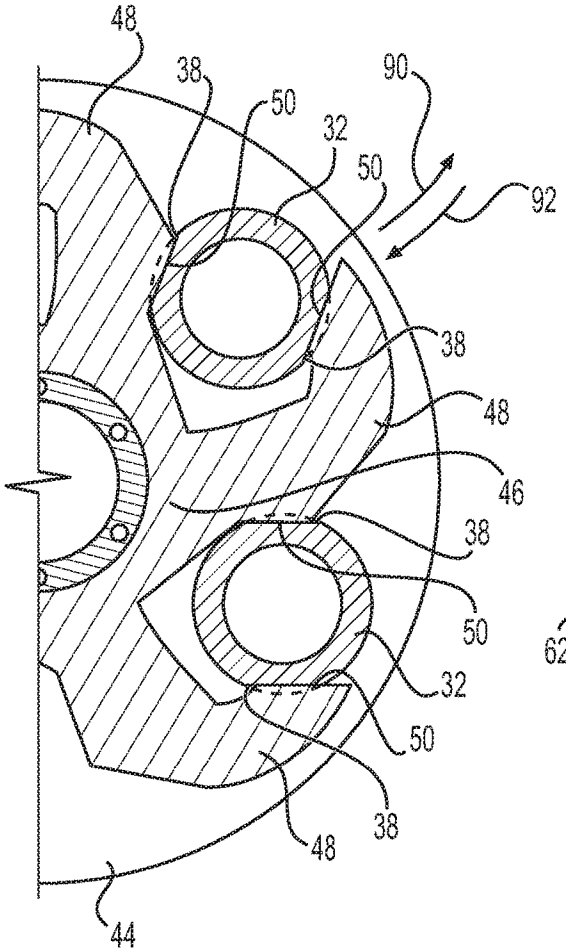
FIG. 3 is a top cross-sectional view of the carousel along line 3-3 of FIG. 2.

FIG. 3 is a cross-sectional top view along line 3-3 of FIG. 2 showing two drill pipes 32 stored within carousel 40 with buckets 42 omitted. As shown in FIG. 3, a lower (distal) retainer member 46 may include arms 48 that each define a pair of opposed flat engagement surfaces 50. Engagement surfaces 50 of arms 48, like engagement surfaces 62 of deck wrench 60, may be shaped so as to generally correspond to opposing flats 38 of each component of drill string 30, e.g. parallel, opposing planar surfaces. Thus, carousel 40 may also form an exemplary securing structure having engagement surfaces 50 shaped to engage flats 38 and secure a drill string component from rotating. An upper (proximal) retainer member 46 may include arms 48 with surfaces that may engage a circumferential surface of drill pipes 32 spaced away from (above or below) flats 38. Alternatively, the upper member 46 may include arms 48 having engagement surfaces 50 so as to engage additional, upper flats 38 of drill pipes 32. Thus, engagement surfaces 50 may provided on one or both of the upper and lower retainer members 46. While engagement surfaces 62 and 50 may be referred to as "flat," it is to be understood that these surfaces are not necessarily completely flat. Additionally, engagement surfaces 62 and 50 may not be precisely parallel to flats 38. Engagement surfaces 62 and 50 may allow for some rotation of flats 38 before contact is established between flats 38 and engagement surfaces 62 or 50. For example, approximately 30 degrees of rotation may be possible prior to contact between flats 38 and surfaces 62 or 50.

Figure 4:
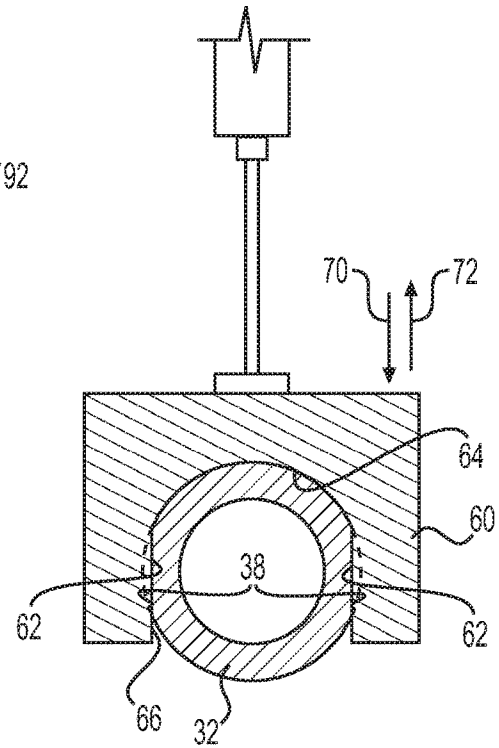
FIG. 4 is a top cross-sectional view of the deck wrench and a drill string component along line 4-4 of FIG. 2.

FIG. 4 is cross-sectional top view along line 4-4 of FIG. 2 showing a drill pipe 32 (or adapter 34 or drill bit 36) having flats 38 that are engaged by deck wrench 60. The pair of opposed engagement surfaces 62 of deck wrench 60 may be connected to each other by an arc-shaped surface 64 that generally corresponds to an outer circumference of drill pipe 32. The opposed engagement surfaces 62 may be suitable for supporting a drill pipe component in a stationary and fixed rotational position while an immediately adjacent (proximal) drill string component is rotated for coupling or decoupling. When flat surfaces 38 are rotationally aligned with engagement surfaces 62, a deck wrench opening 66 may receive the drill string component when deck wrench 60 translates along an engagement direction 70, in accordance with the operation of deck wrench positioning valve 86. A sensor such as a proximity sensor may be provided to detect a position of deck wrench 60, and may detect when deck wrench 60 is fully extended along engagement direction 70 and output this information to controller 110. This signal may allow controller 110 to determine when deck wrench 60 is fully extended. Engagement surfaces 62 may disengage from flat surfaces 38 when deck wrench positioning valve 86 causes deck wrench 60 to move along disengagement direction 72.

Figure 6:
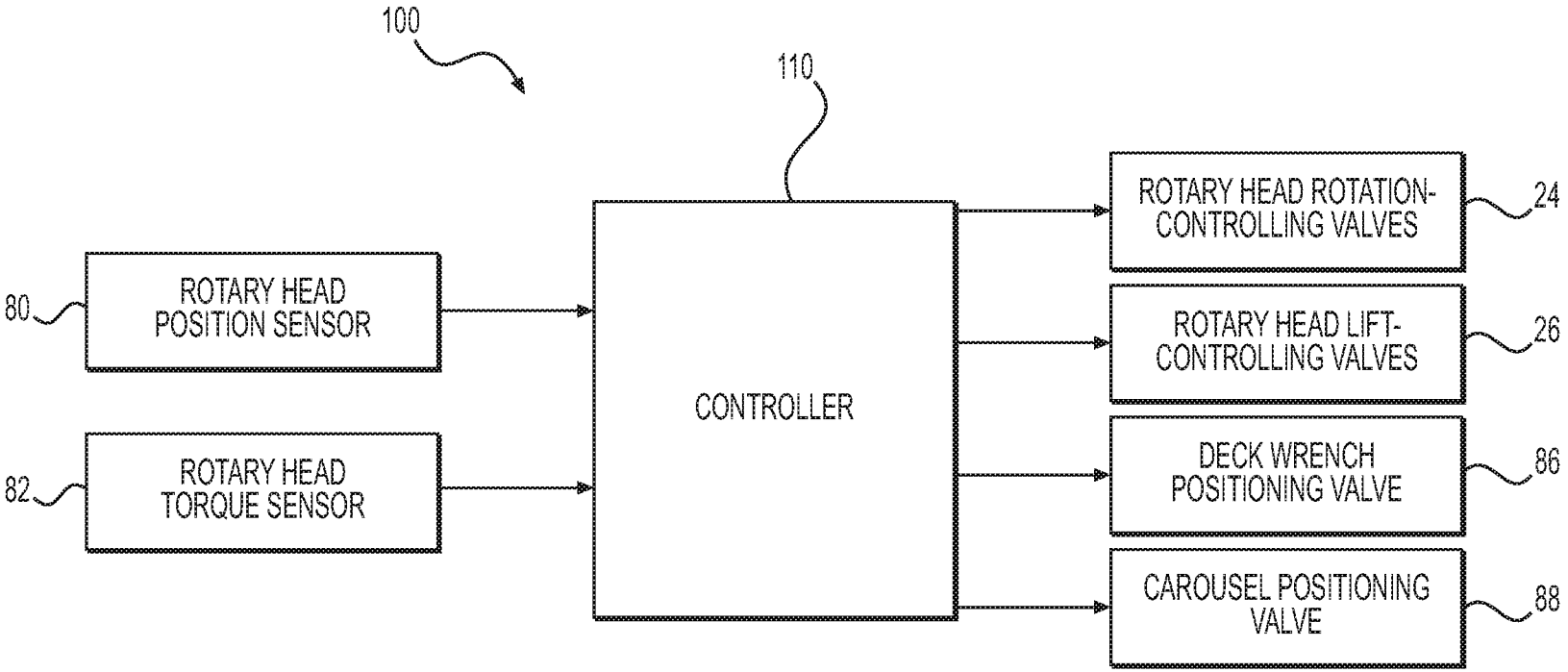
FIG. 6 is a schematic diagram illustrating a control system of the mobile drilling machine of FIG. 1.

FIG. 6 is a schematic view of an exemplary control system 100 of the drilling machine 10 of FIG. 1 that includes controller 110. In an exemplary configuration, control system 100 may include rotary head position sensor 80 and a rotary head torque sensor 82 that provide input signals to controller 110. Outputs of control system 100 may include signals to rotary head rotation-controlling valves 24, rotary head lift-controlling valves 26, deck wrench positioning valve 86, and carousel positioning valve 88.

Controller 110 may include a single microprocessor or multiple microprocessors configured to monitor operation of the drilling machine 10 and issue instructions to components of machine 10. For example, controller 110 may include a memory, a secondary storage device, a processor such as a central processing unit, or any other components and/or circuitry for accomplishing a task consistent with the present disclosure. The memory or secondary storage device associated with controller 110 may store data and/or software routines that may assist controller 110 in performing its functions. Further, the memory or secondary storage device associated with controller 110 may also store data received from sensors 80 and 82, as well as other inputs associated with mobile drilling machine 10. The memory or secondary storage may include a non-volatile memory that allows rotational locations of drill string components to be stored in the event that machine 10 is completely powered off. Upon a subsequent power-up, the rotational locations of each tracked component may be retrieved by controller 110. Numerous commercially available microprocessors can be configured to perform the functions of controller 110. It should be appreciated that controller 110 could readily embody a general machine controller capable of controlling numerous other machine functions. Various known circuits may be associated with controller 110, including signal-conditioning circuitry, communication circuitry, hydraulic or other actuation circuitry, and other appropriate circuitry.

Rotary head position sensor 80 may be any combination of sensors configured to measure a speed and/or a position of one or more rotational components (e.g., shaft 22) of rotary head 20 and output the measured speed and/or position and/or direction of rotation to controller 110. Rotary head position sensor 80 may measure a direction of rotation of one or more rotational components in addition to speed and/or position. For example, rotary head sensor 80 may include a single high-frequency proximity switch or a single hall effect sensor. In such a configuration, controller 110 may determine a direction of rotation based on commands output by controller 110 to rotary head rotation-controlling valves 24. In another exemplary configuration, rotary head sensor 80 may include a pair of (or more) hall effect sensors disposed on a gear wheel in rotary head 20. In such configurations, rotary head sensor 80 may measure a speed and direction of rotation of a component such as shaft 22 of rotary head 20. Rotary head position sensor 80 may be provided in a rotary head 20 having a motor with a final-drive type gearbox having staged gearing. Controller 110 may be configured to convert a measurement of sensor 80 to a rotational location of shaft 22 based on one or more pre-programmed relationships, such as gear ratios, for a hydraulic motor having a final-drive type gearbox. In such motors, a plurality of sensors 80 (e.g., rotational encoders) may be provided on different rotating components (e.g., one or more transmission components, output shafts of the motor, or shaft 22) to provide a more robust source of tracking information. Rotary head position sensor 80 may also be provided in a rotary head 20 having a hydraulic motor that directly drives shaft 22 and drill string 30.

Rotary head position sensor 80 may be configured to determine/track a rotational position or rotational location of rotary head 20. For example, sensor 80 may include a rotary encoder that measures a rotational position of a component (e.g., shaft 22) of rotary head 20. One or more rotary encoders may be provided on a shaft of a rotational component within rotary head 20 to provide a rotational position of the component. Controller 110 may also determine a speed of rotation based on one or more encoders, if necessary. Rotary head position sensor 80 may include a combination of proximity switches, hall effect sensors, and/or encoders.

Rotary head torque sensor 82 may be any sensor configured to provide a signal indicative of a torque applied by rotary head 20. In one exemplary configuration torque sensor 82 may be a pressure sensor provided within a hydraulic line of rotary head 20 to measure a pressure of hydraulic fluid that acts to rotate shaft 22. Torque sensor 82 may include two pressure sensors provided within a hydraulic pump connected to a hydraulic motor within rotary head 20 to determine a pressure difference across the hydraulic motor. This change in pressure may allow for the determination of torque, which may be a motor output torque calculated based on commands for pump displacement (or pump flow) that may indicative of a direction of rotation and commands for motor displacement. Thus, controller 110 may receive pressure information from sensor 82, which may be converted into a torque measurement by controller 110. In one aspect, controller 110 may determine torque based on the detected pressure output by sensor 82 to controller 110 and an amount of displacement of a motor of rotary head 20 that rotates shaft 22 (as measured, e.g., by sensor 80). Such a pressure sensor may be provided at locations within a hydraulic circuit other than rotary head 20. For example, pressure sensor 82 may be provided at any location along a fluid supply line to a hydraulic motor within rotary head 20.

Controller 110 may output a command to control a position of rotary head rotation-controlling valves 24. This command may correspond to a target rotation speed and direction for rotating shaft 22 and one or more components of drill string 30. Controller 110 may similarly output a signal for controlling a position of rotary head lift-controlling valves 26 to control a vertical position of rotary head 20 along mast 18. Controller 110 may output a control signal to carousel positioning valve 88 to move (e.g., swing) a support structure coupled to bottom plate 44 along directions 90 and 92 (FIG. 3). Controller 110 may output a signal to deck wrench positioning valve 86 to translate deck wrench 60 along directions 120 and 122 (FIG. 4). These outputs are merely exemplary, and other outputs may be generated by controller 110 to control components of mobile drilling machine 10.

INDUSTRIAL APPLICABILITY

The disclosed aspects of mobile drilling machine 10 may be employed in a variety of operations associated with drilling. For example, mobile drilling machine 10 may be employed to retrieve, store, track, and update a position of a feature of a drill string component, such as one or more flats on a drill string component, when adding or removing a drill string components. Storing, tracking, and updating the position of flats may also be performed during drilling. Thus, a location of flats, or another feature, may be subsequently employed when engaging a drill string component with a carousel, deck wrench, or other component.

Figure 7:
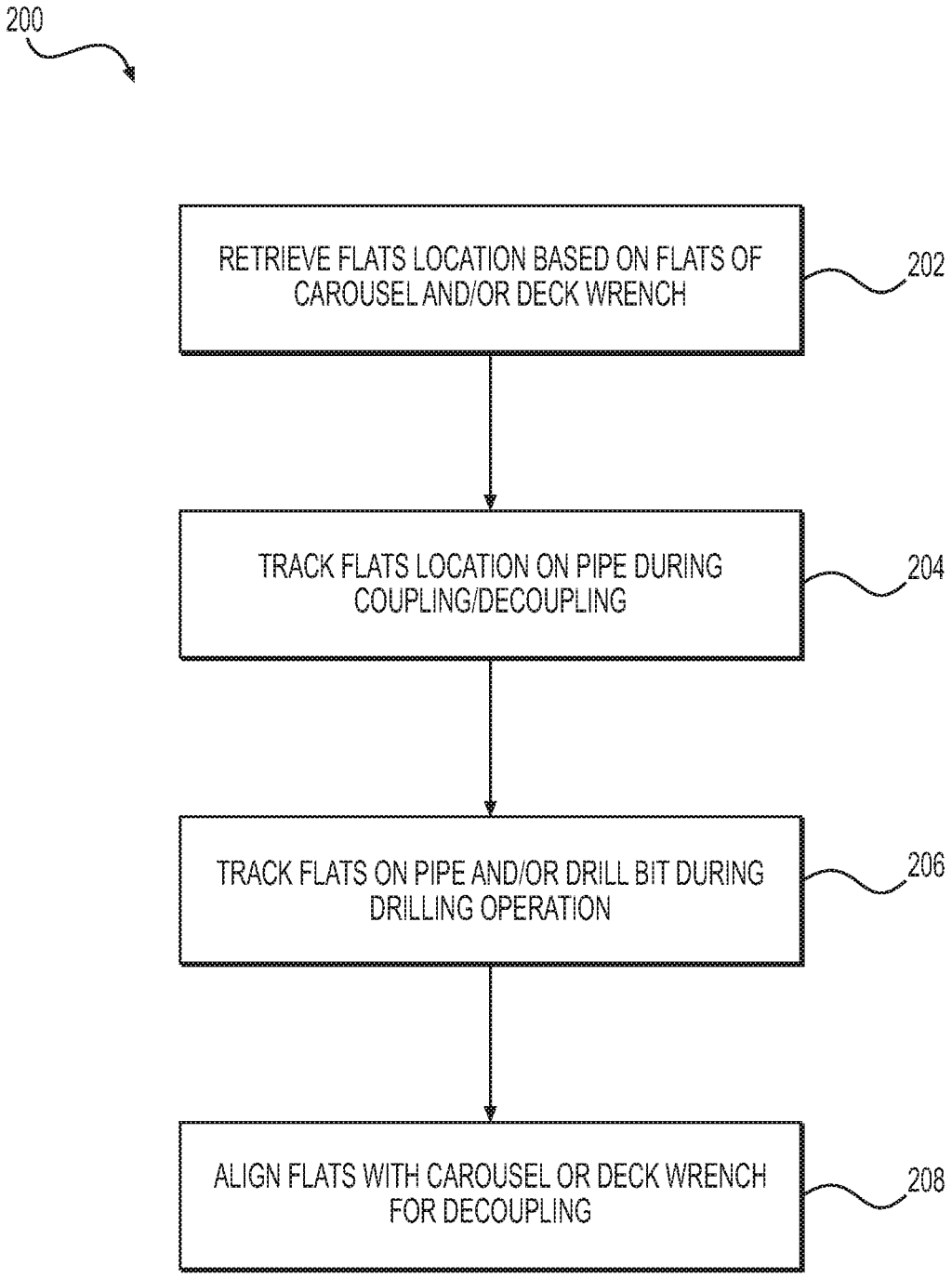
FIG. 7 is a flowchart illustrating a method according to aspects of the disclosure.

FIG. 7 is a flowchart illustrating an exemplary method 200 for tracking a drill string component according to aspects of the disclosure. Method 200 may include, in step 202, retrieving a location of a pair of flat surfaces or flats 38. Step 202 may include retrieving a location of flats 38 during a process of withdrawing a drill string component such as a drill pipe 32 from carousel 40 to add the pipe 32 to drill string 30, as shown in FIG. 2, for example. In order to achieve the withdrawal of a drill pipe 32, carousel positioning valve 88 may cause carousel 40 to swing along direction 90 to the aligned position in which a drill pipe 32 in carousel 40 is aligned with shaft 22 of rotary head 20 and with the components of drill string 30 distal of this pipe 32. The components of drill string 30 below pipe 32 may include one or more pipes 32, an adapter 34, and a drill bit 36 attached to the adapter 34.

Controller 110 may cause shaft 22 to rotate in coupling direction 120, thereby engaging threads of shaft 22 with threads provided at a proximal end of pipe 32 to couple the drill pipe 32 to rotary head 20. As shown in FIG. 3, flat engagement surfaces 50 of arms 48 retain pipe 32 in a constant rotational location during this rotational coupling with shaft 22. This rotational location of flat engagement surfaces 50 may be determined by (e.g., pre-programmed in) controller 110, allowing controller 110 to retrieve an initial location of flats 38 based on the location of engagement surfaces 50 of carousel 40. When a torque applied by shaft 22 (as measured based on sensor 82) reaches a predetermined threshold value and a speed of rotation of shaft 22 (as measured based on sensor 80) is equal to or below a predetermined threshold value (e.g., zero), controller 110 may determine that shaft 22 is fully coupled to pipe 32. Controller 110 may then retrieve and store a rotational location of flats 38. In one aspect, retrieving the rotational location of flats 38 may include determining a rotational location of flats 38 with respect to a rotational location of shaft 22 or another rotating component of rotary head 20. Alternatively, retrieving the rotational location of flats 38 may include determining an absolute rotational location of flats 38. In one aspect, flats 38 may be tracked with respect to 360 degrees of rotation. Due to the symmetry of flats 38, these flats 38 may also be tracked with respect to 180 degrees of rotation, whether tracking is performed with respect to rotary head 20 or with respect to an absolute position. In some configurations, flats 38 may be tracked with respect to 90 degrees or 60 degrees (e.g., by providing additional pairs of flats). Storing the location of flats 38 may include writing the (relative or absolute) rotational location to a memory of controller 110 and associating the rotational location with a particular drill string component. Once the rotational location of flats 38 for the drill string component is retrieved, drill head 20 may raise pipe 32 above bucket 34, after which carousel positioning valve 88 may withdraw carousel 40 along withdrawal direction 92.

In one aspect, a rotational location of flats 38 may also be retrieved when flats 38 are engaged with engagement surfaces 62 of deck wrench 60. The rotational location of flat engagement surfaces 62 may be determined by (e.g., pre-programmed) controller 110, allowing controller 110 to retrieve an initial location of flats 38 when engagement surfaces 62 of deck wrench 60 engage flats 38. Thus, deck wrench 60 may be employed to retrieve or determine the location of flats 38 of a component that was attached to drill string 30 without the use of carousel 40.

For example, a drill string component may be installed to shaft 22 or a drill pipe 32 via deck wrench 60. In such an installation process, flats 38 associated the drill string component may first be vertically aligned with deck wrench engagement surfaces 62. Deck wrench 60 may then translate along extension direction 96 to attempt to engage flats 38 with engagement surfaces 62. As flats 38 may not yet be rotationally aligned with engagement surfaces 62, deck wrench 60 may contact the outer circumference of the drill pipe component before fully extending along extension direction 90. This interference may be detected by controller 110, which then withdraws deck wrench 60 along direction 92. The adapter 34 or drill bit 36 may then be rotated a predetermined amount and an additional attempt is performed to engage flats 38 with engagement surfaces 62 of the deck wrench 60. Once this engagement is completed successfully, controller 110 may retrieve and store the location of flats 38 of pipe 32, adapter 34, drill bit 36, or any other drill component.

The use of deck wrench 60 to retrieve the location of flats 38 may be useful when a drill string component, such as drill bit 36, is connected to shaft 22 or a drill pipe 32 in a manual process. Deck wrench 60 may also be used to retrieve the location of flats 38 in an automated drill tool changing process. For example, an automated drill tool changing device (not shown) may retain one or more drill bits 36 and may include engagement surfaces similar to surfaces 50 and 62. In such a configuration, controller 110 may retrieve and store a location of flats 38 of drill bit 36 in a manner similar to the withdrawal of a drill pipe 32 from carousel 40 or the use of deck wrench 60.

Figure 5:
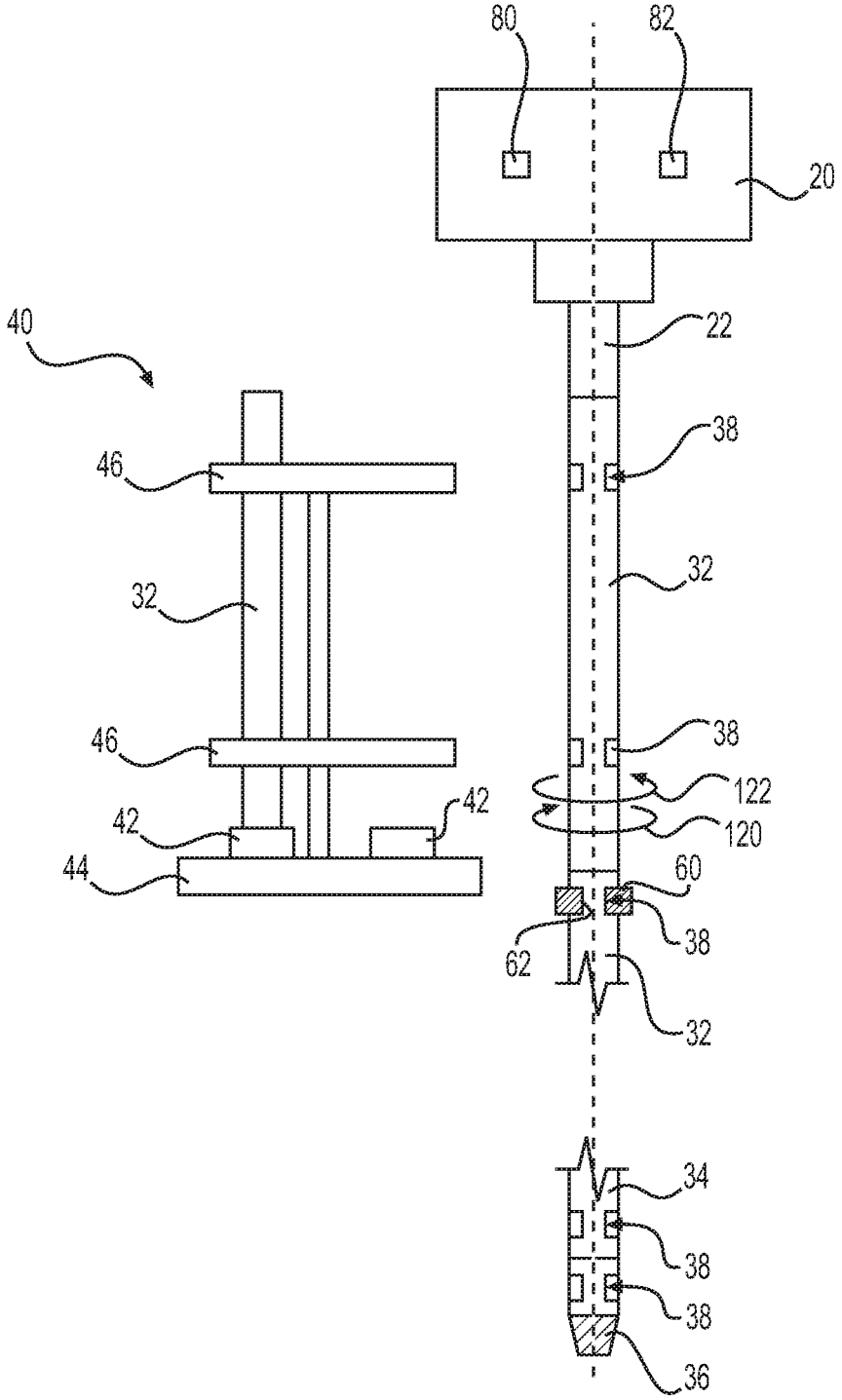
FIG. 5 is a schematic side view of a rotary head, drill string, carousel, and deck wrench of the mobile drilling machine of FIG. 1, with the carousel in a withdrawn position.

Step 204 of method 200 may include tracking a location of flats 38 during coupling and decoupling of components of drill string 30. For example, as shown in FIG. 5, during a coupling process, rotary head 20 may rotate shaft 22 and a proximal drill pipe 32 in a coupling direction 120, while a distal drill pipe 32 (an exemplary additional drill string component) is secured by deck wrench 60. During this coupling, the change in the rotational location of flats 38 on the proximal drill pipe 32 may be tracked by controller 110 based on tracking information. This tracking information may include tracking information received as a signal from a sensor associated with rotary head. In one aspect, tracking information may be received from by one or more rotary head position sensors 80. If necessary for the type(s) of sensors employed, this tracking information may be correlated with commands output by controller 110 (e.g., to rotary head rotation-controlling valves 24) to determine a direction of rotation.

While controller 110 tracks (e.g., updates) the changing position of flats 38 on drill pipe 32, controller 110 may also continue to store the location of at least one pair of flats 38 on each component of drill string 30 provided distally with respect to the rotating drill pipe 32. Thus, controller 110 may determine a change in the location of flats 38 on the rotating drill string component (an exemplary first drill string component) as these flats 38 rotate with respect to flats 38 of one or more non-rotating drill string components (an exemplary second drill string component) during coupling or decoupling. Specifically, controller 110 may track the location of flats 38 on each drill string component by tracking and updating the location of the rotating drill string component, which may be located on a proximal end of drill string 30. During the rotation of this proximal drill string component, controller 110 may determine that the location of flats 38 disposed distally of the rotating drill string component remain constant.

A rotational location of each pair of flats 38 may be tracked with respect to a component of rotary head 20, such as shaft 22. For example, a relative alignment between flats 38 and shaft 22 may be retrieved, stored, and updated by controller 110. The relative alignment between one or more drill string components and shaft 22 may be updated during coupling and decoupling. For example, the rotational location of flats 38 may be tracked by determining the amount of rotation of shaft 22 during coupling or decoupling, and updating the relative alignment between flats 38 and shaft 22 accordingly for each stationary drill string component. The location of flats 38 of the drill string components may also be tracked with respect to flats 38 of another drill string component. Additionally or alternatively, the location of flats 38 may each be tracked individually (e.g., by tracking an absolute location of a plurality of pairs of flats along 360 degrees, 180 degrees, etc.).

During step 206, a drilling operation may be performed. During a drilling operation, rotary head 20 may rotate each of the components of drill string 30 as a unit. The location of at least one pair of flats 38 may be tracked based on a direction of rotation measured from sensor 80 or determined based on the commands to operate valves 24. In one aspect, controller 110 may track the location of flats 38 of a plurality of components of drill string 30 during drilling, including a drill string component that was coupled to a plurality of additional drill string components during step 204.

In a step 208, decoupling may be performed, for example, following a drilling operation to withdraw drill string 30 from the completed blasthole. Controller 110 may therefore cause rotary head 20 to rise to a position at which flats 38 of a drill string component are vertically-aligned with deck wrench 60. Such an alignment is shown in FIG. 5, for example. The drill string component having these flats 38 may be a drill string component (e.g., a drill pipe 32 as shown in FIG. 5) immediately adjacent (distal) with respect to the drill string component that will be decoupled. As the position of flats 38 on this component were retrieved and tracked, controller 110 may determine an amount of rotation necessary to rotationally align flats 38 with engagement surfaces 62. Controller 110 may then (automatically) control rotary head 20 to rotate drill string 30 (via shaft 22) by an amount necessary to bring flats 38 in rotational alignment with a securing structure, for example by rotationally aligning flats 38 with engagement surfaces 62 of deck wrench 60. With reference to FIG. 4, after this alignment has been performed, controller 110 may control valve 86 to extend deck wrench 60 along extension direction 92, bringing engagement surfaces 62 into a position immediately adjacent to flats 38 so as to surround flats 38.

While flats 38 of the distally-located drill string component are secured by engagement surfaces 62 of deck wrench 60, the proximally-located drill string component engaged with shaft 22 may be rotated in decoupling direction 122 (FIG. 5). During this rotation, flats 38 of the rotating drill string component may be tracked and updated by controller 110, while the flats 38 of all other drill string components are determined to be held constant as these components may remain stationary. Once controller 110 determines that decoupling is complete, controller 110 may determine an amount of rotation necessary to rotationally align flats 38 of the proximal drill string component with a securing structure, for example by (automatically) controlling rotary head 20 to rotate shaft 22 and align flats 38 with a pair of arm engagement surfaces 50 (FIG. 3) of the carousel 40 (FIG. 3). Once the flats 38 are rotationally aligned with arm engagement surfaces 50, controller 110 may cause carousel positioning valve 88 to swing carousel 40 from the withdrawn position to the aligned position. As the flats 38 were previously brought into rotational alignment with arm engagement surfaces 50, the movement of carousel 60 may cause the drill pipe 32 to directly enter an empty position within carousel 60. Now that the drill pipe 32 is fixed from rotation, drill head 20 may rotate to decouple shaft 22 from pipe 32 for storage of 32 in a bucket 42 carousel 40.

During steps 202, 204, 206, and 208, a location of a pair of flats 38 for each drill string component may be retrieved and stored by associating the rotational location with the drill string component. In one aspect, the location of each drill string component on drill string 30 may be tracked as drill string components are added and removed. For example, a first drill string component may be withdrawn from carousel 40 and coupled to shaft 22 to form a component of drill string 30. Controller 110 may retrieve and store the location of the flats 38, as well as an axial position of this first drill string component on drill string 30. Controller 110 may, for example, determine the axial position of each drill string component with respect to drill bit 36. When a first drill string component is added to drill bit 36, controller 110 may associate a first (most-distal) position with this drill string component. When a second drill string component is added, controller 110 may determine that the position of this component is one position higher (proximal) with respect to the first drill string component. Alternatively, controller 110 may determine the axial position of each drill string component with respect to rotary head 20. The rotational location of flats 38 may be updated accordingly to ensure that the tracked flats 38 are associated with the component at each axial position of the drill string 30.

Steps 202, 204, 206, and 208 of method 200 are not necessarily performed in the sequence illustrated in FIG. 7. In fact, steps 202, 204, 206, 208, may be performed in any order, may be repeated, and may be omitted as necessary or desired. For example, once drilling has reached a desired depth in step 206, controller 110 may decouple drill string components as necessary by repeatedly performing steps 204 and 208.

The mobile drilling machine 10 and control system 100 may allow retrieval, storage, and tracking of a plurality of flats located on the components of a drill string. Once the location of a flat is known, this location may be tracked throughout the drilling process, including during coupling and decoupling of drill string components. By tracking the location of the flats, it may be possible to rotate a drill string component into alignment with an engagement surface of a deck wrench or a carousel, allowing the flats to engage the engagement surface. In some embodiments, this may eliminate the need to make multiple attempts to engage the drill string component with the deck wrench or carousel. Thus, wear is reduced and drilling operations may be performed in less time with greater efficiency. Additionally, tracking the location of flats may assist with an automated process, including autonomous drilling.

It will be apparent to those skilled in the art that various modifications and variations can be made to the disclosed method and system for operating a drilling machine without departing from the scope of the disclosure. For example, while the system and methods disclosed herein are associated with mobile drilling machines, it is understood that the features disclosed and not so limited and are applicable to other drilling systems, including stationary drilling systems. Other embodiments of the method and system for drilling will be apparent to those skilled in the art from consideration of the specification and practice of the systems disclosed herein. It is intended that the specification and examples be considered as exemplary only, with a true scope of the disclosure being indicated by the following claims and their equivalents.

What is claimed is:

1. A drilling machine comprising:
- a mast;
- a rotary head movably coupled to the mast;
- a drill string component having a pair of opposed flat surfaces;
- a securing structure including engagement surfaces shaped to engage the opposed flat surfaces and secure the drill string component from rotating; and
- a controller configured to track a rotational location of the opposed flat surfaces of the drill string component during rotation of the drill string component; the controller further configured to
  - receive tracking information from a sensor associated with the rotary head; and
  - control the rotary head to align the opposed flat surfaces for engagement by the securing structure.

2. The drilling machine of claim 1, wherein the securing structure is at least one of a pipe storing carousel or a deck wrench.

3. The drilling machine of claim 1, wherein the engagement surfaces are provided on arms of a pipe storing carousel.

4. The drilling machine of claim 1, wherein the controller is further configured to retrieve an initial location of the opposed flat surfaces based on a location of the engagement surfaces on a pipe storing carousel.

5. The drilling machine of claim 1, wherein the controller is further configured to retrieve an initial location of the opposed flat surfaces based on an engagement of the opposed flat surfaces by engagement surfaces on a deck wrench.

6. The drilling machine of claim 1, wherein the tracking of the location of the opposed flat surfaces takes place during coupling and decoupling of the drill string component to an additional drill string component.

7. The drilling machine of claim 1, wherein the drill string component is coupled to a plurality of additional drill string components and the controller is further configured to track a location of the opposed flat surfaces of the drill string component and the plurality of additional drill string components.

8. The drilling machine of claim 1, wherein the drill string component is a first drill string component, and the controller is further configured to track a rotational location of the opposed flat surfaces of the first drill string component, and track a rotational location of opposed flat surfaces of a second drill string component when the first pair of opposed flat surfaces rotates with respect to the second pair of opposed flat surfaces.

9. The drilling machine of claim 1, wherein the drill string component is a drill bit.

10. The drilling machine of claim 1, wherein the sensor includes at least one of a proximity sensor, a hall effect sensor, or a rotational encoder.

11. A mobile drilling machine system comprising:
- a mast;
- a rotary head movably coupled to the mast;
- a drill string component having a pair of opposed flat surfaces;
- a pipe storing carousel supporting the drill string component;

a pair of opposed engagement surfaces in the pipe storing carousel that engage the opposed flat surfaces of the drill string component;

a sensor configured to detect a rotation of the rotary head; and a controller configured to control the rotary head to rotate the drill string component into alignment with the pair of opposed engagement surfaces in the carousel based on a change in a rotational location of the drill string component determined at least in part by the detected rotation.

12. The mobile drilling machine of claim 11, wherein a first said pair of opposed engagement surfaces are provided on arms of the carousel.

13. The mobile drilling machine of claim 12, further comprising a deck wrench, wherein a second said pair of opposed engagement surfaces are provided on the deck wrench.

14. The mobile drilling machine of claim 11, wherein the controller is further configured to retrieve an initial location of the opposed flat surfaces based on a location of the opposed engagement surfaces on the pipe storing carousel.

15. The mobile drilling machine of claim 11, wherein the drill string component is a first drill string component and the opposed flat surfaces of the first drill string component are a first pair of opposed flat surfaces, and wherein the controller is configured to track a change in rotational location between the first pair of opposed flat surfaces and a second pair of opposed flat surfaces of a second drill string component when the first pair of opposed flat surfaces rotates with respect to the second pair of opposed flat surfaces during a decoupling of the first and second drill string components.

16. A method for tracking a pair of flat surfaces of a drill string component comprising:

determining a rotational location of the pair of flat surfaces;

performing a drilling operation that includes rotating the drill string component;

tracking a change in the rotational location of the pair of flat surfaces during the drilling operation; and automatically rotating the drill string component by an amount determined to place the drill string component in alignment with a deck wrench based on the tracked change in the rotational location.

17. The method of claim 16, wherein a plurality of engagement surfaces are provided on an arm of a pipe storing carousel.

18. The method of claim 16, wherein a plurality of engagement surfaces are provided on the deck wrench.

19. The method of claim 16, wherein the tracking the change in the rotational location of the pair of flat surfaces is performed during a coupling of a first drill string component to a second drill string component.

20. The method of claim 16, wherein the tracking the change in the rotational location of the pair of flat surfaces is performed during a decoupling of a first drill string component and a second drill string component.

* * * * *